US006062234A

United States Patent [19]

Finocchiaro et al.

[11] Patent Number: 6,062,234

[45] Date of Patent: May 16, 2000

[54] DEVICE FOR SINGLE COSMETIC APPLICATION

[75] Inventors: Sylvie A. Finocchiaro, New York, N.Y.; Jacques A. Gerbron, Menton, France

[73] Assignee: Coty Inc., New York, N.Y.

[21] Appl. No.: 09/143,225

[22] Filed: Aug. 28, 1998

Related U.S. Application Data

[60] Provisional application No. 60/079,243, Mar. 25, 1998.

[51] Int. Cl.[7] ..... A45D 40/00

[52] U.S. Cl. ..... 132/320; 132/294; 132/317

[58] Field of Search ..... 132/233, 294, 132/300, 320, 317; 206/823

[56] References Cited

U.S. PATENT DOCUMENTS

| | | | |
|---|---|---|---|
| 965,291 | 7/1910 | Gillette | 132/293 |
| 1,791,351 | 2/1931 | Chase | 15/229.14 |
| 1,888,314 | 11/1932 | Framke . | |
| 2,100,855 | 10/1937 | Kelly | 132/317 |
| 2,654,471 | 10/1953 | Salfisberg | 206/484 |
| 2,656,090 | 10/1953 | Hamblet | 132/293 |
| 2,964,045 | 12/1960 | Otto et al. | 132/317 |
| 3,103,224 | 9/1963 | Dearling | 401/123 |
| 4,332,319 | 6/1982 | Hurwood | 206/210 |
| 4,828,419 | 5/1989 | Porter et al. | 401/126 |
| 4,832,060 | 5/1989 | Kingsford | 132/293 |
| 4,925,667 | 5/1990 | Fellows et al. | 424/401 |
| 5,254,109 | 10/1993 | Smith et al. | 604/289 |
| 5,301,697 | 4/1994 | Gueret | 132/298 |
| 5,857,564 | 1/1999 | Hymowitz | 206/823 |

FOREIGN PATENT DOCUMENTS

| | | | |
|---|---|---|---|
| 0441667 | 10/1991 | European Pat. Off. | 132/320 |

*Primary Examiner*—Paul J. Hirsch
*Assistant Examiner*—Michael B. Priddy
*Attorney, Agent, or Firm*—Schwegman, Lundberg, Woessner & Kluth, P.A.

[57] ABSTRACT

The present invention includes an applicator device that comprises a first sheet with a bottom surface and a top surface. A cosmetic portion is positioned on the top surface of the first sheet. The applicator device also includes a second sheet that comprises a bottom surface facing the top surface of the first sheet and the cosmetic portion. A plurality of fibers is positioned on either the top surface of the second sheet or the bottom surface of the second sheet or both. An adhesive adheres the first sheet to the second sheet.

20 Claims, 5 Drawing Sheets

DEVICE FOR SINGLE COSMETIC APPLICATION

This application is a Continuation-In-Part and claims the benefit of U.S. Provisional Application No. 60/079,243 which was filed Mar. 25, 1998.

FIELD OF THE INVENTION

The present invention relates to a device for storing cosmetics and applying cosmetics in a predetermined quantity.

BACKGROUND OF THE INVENTION

Human beings have been applying makeup to their faces since ancient times, and perhaps even longer than that. In a tomb in the Sumerian city of Ur, from the end of the third millennium B.C., archeologists found a tiny gold, shell-shaped cosmetics case containing a makeup kit. The Egyptians kept cosmetic ingredients in lumps in little bags made of leather or linen. The lumps were ground on a palette to a fine powder and were applied to skin with a moistened stick of wood, ivory, silver, glass or bronze. Peter James and Nick Thorp in the book *Ancient Inventions* (1994) at page 256 describe makeup kits that contained these elements together with the palettes for grinding the lumps into powders. These makeup kits were found in the graves of ancient Egyptian nobility dating back as early as 4000 B.C. Both Egyptian men and women lightened their skin with yellow ochre. Only women used orange paint to make the ochre darker. A rouge of red ochre and fat was applied to the cheeks and a similar mixture was applied to the lips.

Messrs. James and Thorp describe the people of the Indus Valley civilization during the third millennium B.C. as lightening their complexions with a face cream comprising white lead. Cakes of this white lead cosmetic have been found in urban houses of the third millennium period and later periods throughout the world.

Advancement in the technology of cosmetic applicators continues to the present day. U.S. Pat. No. 4,751,193 ('193) describes a cosmetic sampler in which a cosmetic preparation is printed onto a base and a thin, mostly transparent, protective film is arranged above it. The protective film is partially bonded to the base.

A cosmetic sampler described in the '193 patent is usable for testing the color of cosmetic preparations such as nail lacquer, blush, and powder. Application of the preparations utilizing the transparent protective film or smooth base film may result in uneven distribution of the cosmetic preparation on the skin.

E.P. Application 722,676 describes a cosmetic sampler in which at one location of the base, a cosmetic or other material has been applied and another small area of the base has been sprinkled with fiber flecks. The sampler is stamped out or cut to a certain shape in order to serve as an applicator. In other embodiments, this applicator is strip-shaped or is an indentation in the base.

SUMMARY OF THE INVENTION

One embodiment of the present invention includes an applicator device that comprises a first sheet that comprises a bottom surface and a top surface. A cosmetic portion is positioned on the top surface of the first sheet. The device also includes a second sheet that comprises a bottom surface that faces the top surface of the first sheet and the cosmetic portion. The second sheet also includes a top surface. A plurality of fibers is positioned on the top surface of the second sheet and an adhesive adheres the first sheet to the second sheet.

One other embodiment of the present invention includes an applicator device that comprises a first sheet that comprises a bottom surface and a top surface. A cosmetic portion is positioned on the top surface of the first sheet. The device also includes a second sheet that comprises a bottom surface facing the top surface of the first sheet and the cosmetic portion. The top surface comprises foam or sponge. An adhesive adheres the first sheet to the second sheet.

Another embodiment of the present invention includes a kit that comprises one or more applicator device or devices and a container. The applicators are located within the container.

One other embodiment of the present invention includes a method for applying cosmetics in order to reduce skin infections caused by cosmetic application. The method includes providing the applicator device of the present invention and using the fiber or sponge elements of the applicator device to apply a single dose of cosmetic. The method also includes disposing of the applicator device after a single use.

DETAILED DESCRIPTION OF PREFERRED EMBODIMENTS

Figure 9:
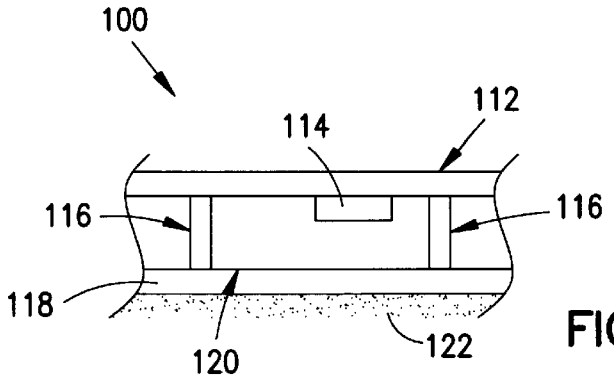
FIG. 9 is a cross sectional view of one embodiment of the device of the present invention.

One embodiment of the cosmetic applicator device of the present invention illustrated in cross-section at 100 in FIG. 9 comprises a sheet 112 with a cosmetic portion 114 adhered to the sheet 112, an adhesive 116 annularly disposed about the sheet 112, a sheet 118 adhered to the adhesive 116 disposed adjacent to the annular perimeter of the sheet 118 comprising a sheet surface 120 facing the cosmetic portion 114 and a fibrous material or foam or sponge surface 122 facing away from the cosmetic portion 114.

As used herein, the term "cosmetic" refers to materials such as lipstick, foundation, blush, eye shadow, powder and lipgloss. The term "fiber" or "fibrous surface" or "fibrous material" as used herein refers to strands or filaments of a natural material such as cotton or a synthetic material such as polyamide or polyester or rubber, which are capable of taking up cosmetic. The strands of material may be woven or nonwoven, flocked, or opened.

The device of the present invention 100 provides to a consumer an ability to use a single application of a cosmetic, such as a powder, without reuse of an applicator. Consequently, the applicator device of the present invention enables a consumer to apply makeup in a hygienic manner and, consequently, avoid infection from microbes adhering to a reusable applicator, such as a brush.

Traditionally, women have tended to apply cosmetics with their own personal brush or set of brushes. Women have not tended to clean the brush each time after use. Consequently, blemishes or infections caused by microbes are perpetuated and spread to other areas of the face due to continued use of the same brush. The applicator device of the present invention substantially eliminates this problem because the applicator is not reused. Furthermore, because the applicator material 122 faces away from the cosmetic, the applicator does not become contaminated with the cosmetic prior to use by a consumer.

Figure 5:
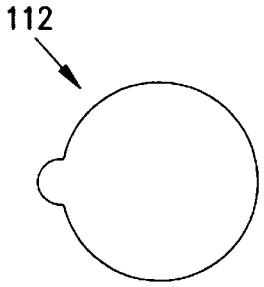
FIG. 5 is a top plan view of a bottom surface of a bottom sheet of the device of the present invention.

The applicator device of the present invention is made by providing a thin material such as a polymeric film such as polyethylene or polypropylene or a coated paper or an uncoated paper such as Velum. The thin material is cut into a shape such as a circular shape as is illustrated at 112 in FIGS. 5 and 6. The bottom surface of the bottom sheet 112 of the thin material may be printed or unprinted. The top surface of the bottom sheet of the thin material bears a cosmetic portion 114.

The cosmetic portion 114 is, in one embodiment, a mixture of cosmetic particles or a cosmetic emulsion that is dispersed in a solvent. The cosmetic portion may additionally include encapsulated microparticles containing a fragrance or fluid such as foundation, blush or lipstick. The cosmetic portion may comprise, in another embodiment, an oleaginous-based cosmetic, containing at least thirty percent of an oil, a fat and/or a wax. In one other embodiment, the cosmetic is mixed with particles such as talc, binders and a volatizing agent. The cosmetic portion 114 is applied to the top surface of the bottom sheet by a method such as printing, i.e. screen printing, blowing, pressing, spreading, flexography, extrusion or other application method.

Figure 6:
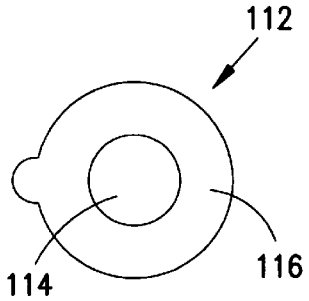
FIG. 6 is a top plan view of a top surface of the bottom sheet of the device of the present invention.
Figure 12A:
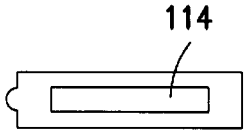
FIG. 12*a* is a top plan view of one embodiment of the top surface of the bottom sheet of the device of the present invention.
Figure 12B:
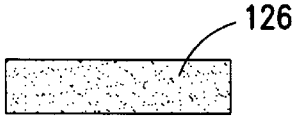
FIG. 12*b* is a top plan view of one embodiment of the top surface of the top sheet of the device of the present invention.

The cosmetic portion 114 is illustrated as a circle positioned in the center of the sheet 112 in FIG. 6. However, it is contemplated that the cosmetic portion 114 may have other symmetries in order to accommodate specific usage of the cosmetic. For instance, FIG. 12 shows the cosmetic portion 114 as having a rectangular shape.

Adhesive 116 is applied annularly to the sheet 112. Preferred adhesives include a physically curing pressure-sensitive adhesive or a heat-assisted chemically curing adhesive, such as polyvinyl alcohol, latex, ethyl alcohol acetate and similar adhesives. The adhesive is selected in such a way that on one hand it assures adhesion between the top 118 and the bottom 112 sheets, and on the other hand, enables easy separation of the top sheet from the bottom sheet.

In one embodiment, the adhesive 116 is applied in dots adjacent to the perimeter of the top surface 116 of the bottom sheet 112. The area covered by the adhesives is about 1 millimeter wide and about 1–10 millimeters long and is distributed in an annular shape around the cosmetic portion 114, spaced apart about 3–10 millimeters. The adhesive is selected in order to assure adhesion between the bottom sheet 112 and the top sheet 118 and enables easy separation of one sheet from the other without a significant amount of pulling being required by a consumer. It is contemplated that the adhesive may be applied in other patterns in order to acceptably adhere the two sheets.

Figure 7:
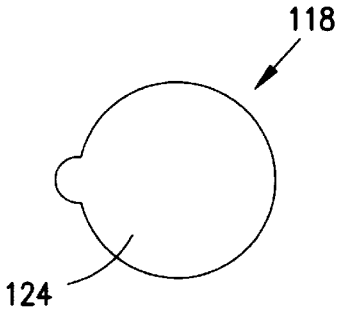
FIG. 7 is a top plan view of a bottom surface of a top sheet of the device of the present invention.
Figure 8A:
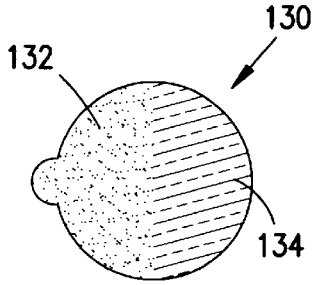
FIG. 8*a* is a top plan view of the top surface of the top sheet wherein the top surface comprises fibers and sponge or foam sections.
Figure 8B:
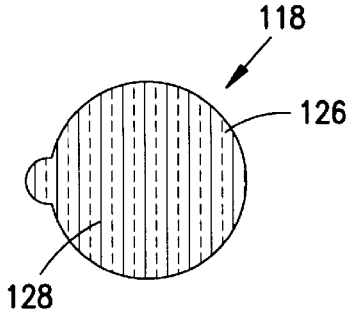
FIG. 8 is a top plan view of a top surface of the top sheet of the device of the present invention.

The top sheet 118 illustrated in FIGS. 7 and 8 comprises a bottom surface 124 illustrated in FIG. 7 and a top surface 126 illustrated in FIG. 8. In one embodiment, the bottom surface 124 comprises a material such as paper, i.e. Velum, coated paper, or a polymeric film such as polyethylene, polypropylene, ethylene methacrylate copolymer, ethylene acrylic acetate or copolymers or blends thereof containing polybutylene, ethylene vinyl acetate or polystyrene. The embodiment shown in FIG. 7 is free of adhesive. It is contemplated, however, that adhesive may be positioned adjacent to the perimeter of the bottom surface of the top sheet 118 either in lieu of placement of adhesive on sheet 112 or in addition to the placement of adhesive on sheet 112.

The top surface of sheet 118 comprises an applicator material 128. The applicator material is, in one embodiment, a nonwoven material comprising individual fibers of varying length. The application material may also comprise fiber flocks that are pressed onto the surface 126 with a material such as a pressure-sensitive adhesive. The applicator material may be made from materials such as polypropylene, rubber, yulculon, polyester, cotton, viscose, or polyacrylic material. The fibers may be swelled fibers. The fibers may be soft to the skin. These soft fibers include a synthetic pile fabric made by a flocking procedure that includes placing the top sheet of the applicator, fabric segments and adhesive in an electrostatic field. Within the field the segments are aligned perpendicular to the base sheet while being adhesively bonded thereto.

In one embodiment, illustrated at 130 in FIG. 8A, the applicator material comprises a fibrous segment 132 and a flocked segment 134. The presence of two separate types of applicator materials permits a consumer to apply and smooth out, or disperse, the cosmetic product with greater versatility. The consumer may apply the cosmetic with the fibrous segment 132 and smooth out the cosmetic with the flocked segment 134. While a fibrous segment 132 and a flocked segment 134 are shown, other applicator material segments may be used. For instance, flocked segment may be positioned with a rubber segment or a fibrous segment may be positioned with a rubber segment. Fibrous segments with different lengths and different degrees of stiffness may be positioned adjacent to each other. The types of segments employed are optimal for a particular function of application or spreading of a particular cosmetic.

In one other embodiment, the sheet 118 comprises a flexible and soft material made with a foam-like material that may be textile-based or polymer-based or based on a textile and a polymer. The polymer-based foam-like material may be polyethylene having an openweb structure.

Figure 10:
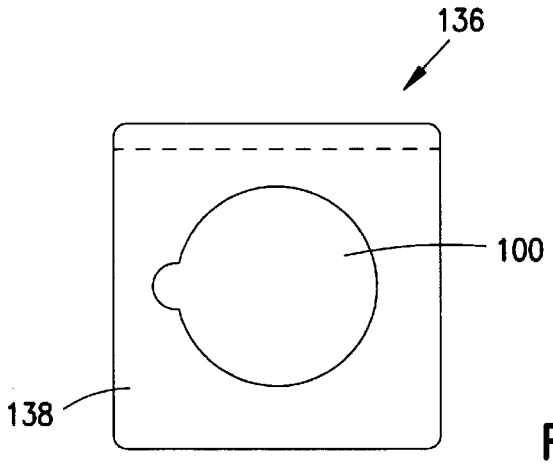
FIG. 10 is a top plan view of one embodiment of the applicator device of the present invention within a container.

In one embodiment, illustrated at 136 in FIG. 10, one or more of the applicator devices of the present invention 100 is positioned within a package 138. The package 138 permits the applicator device to be transported hygienically to maintain cleanliness by preventing contact from any person or object other than the end user. The packaging 138 is, in one embodiment, transparent so that a consumer can view the applicator device. It is acceptable, however, for the package 138 to be translucent or opaque. The package, in one embodiment, is opened when a consumer tears along a scored line or cuts the package material. In another embodiment, the package includes a reclosable seal and is reclosable. The package may be made from materials such as paper or a polymeric material.

Figure 13:
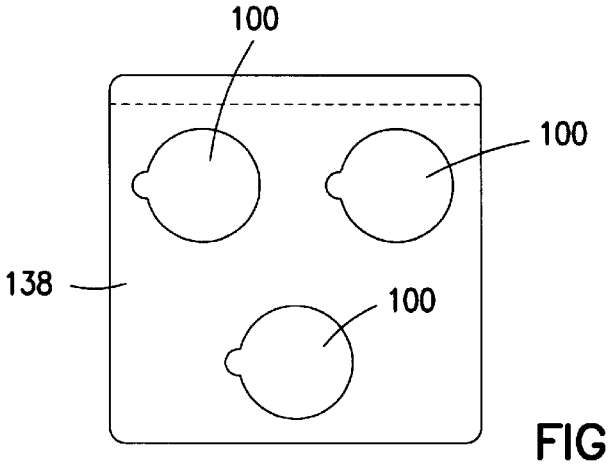
FIG. 13 is a top plan view of a kit comprising a plurality of applicator devices of the present invention within a container.
Figure 15:
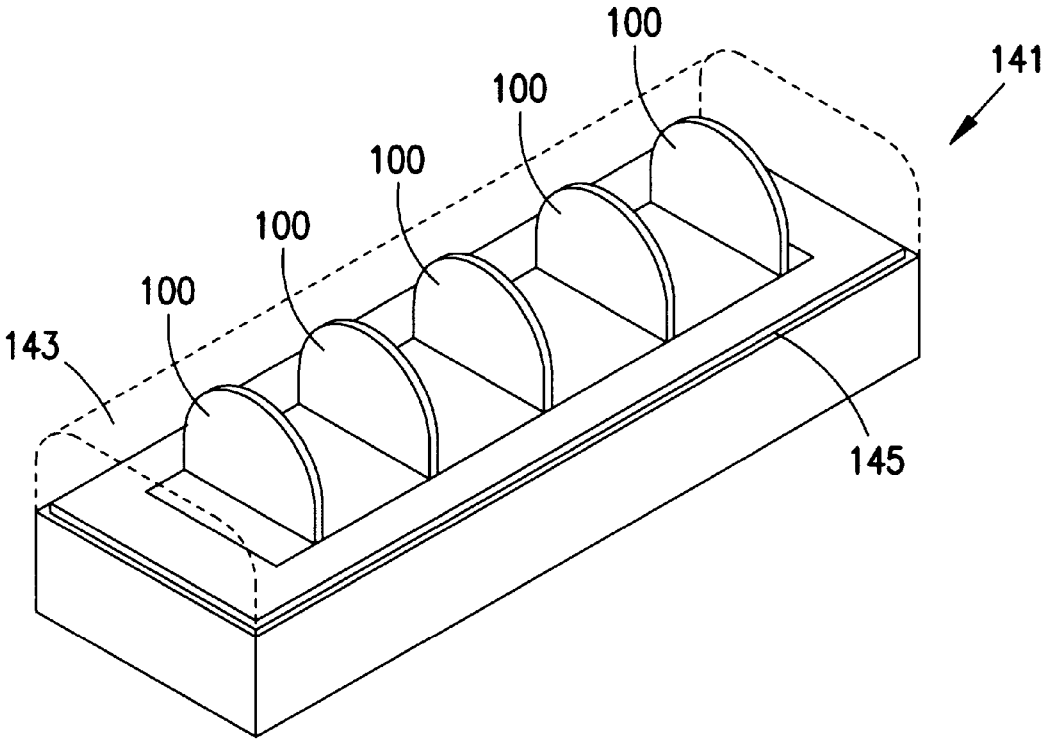
FIG. 15 is a perspective view of one embodiment of a slotted tray for storing a plurality of applicators of the present invention.

In one embodiment, the plurality of devices are enclosed in the package 138 which is resealable. While a flexible bag is shown in FIG. 13, the package may be a box or a tray, such as is shown at 141 in FIG. 15. The tray 141 defines slots for the applicator devices. A cover 143 is positioned over the tray 141 and is retained about a flange 145 on the tray 141. The flexible bag or tray may store enough cosmetic applicators for weeks of use.

Figure 16:
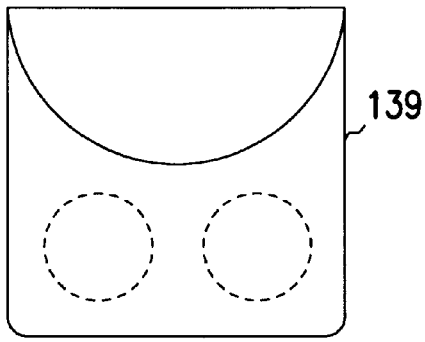
FIG. 16 is a side view of one embodiment of a sachet for containing a small quantity of applicators.

The package or tray may contain applicators with a single type of cosmetic or may contain applicators with several cosmetics, such as foundation, powder, lipstick and blush. The package 138 is a package for storage. A second reclosable sachet, illustrated at 139 in FIG. 16 is also provided for transfer of applicator devices for use on a trip or for reapplying cosmetics during the day.

In one embodiment, the bottom surface of sheet 112 is printed with information identifying the product. In another embodiment, the package 138 is printed with information identifying the product.

The package 138 may include a plurality of devices such as is illustrated in FIG. 13. Each of the pluralities of the devices may comprise a separate type of cosmetic material such as powder, lipstick, eye shadow, and so forth. In another embodiment, each applicator device 100 comprises a single type of cosmetic material such as powder or lipstick.

Figure 11:
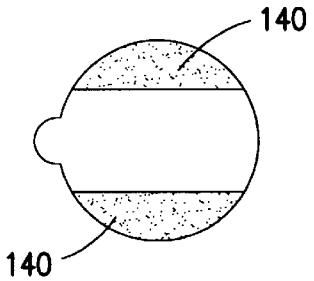
FIG. 11 is a top plan view of one other embodiment of the top surface of the top sheet of the device of the present invention.
Figure 14A:
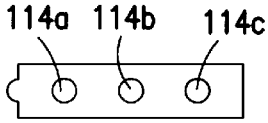
FIG. 14*a* is a top plan view of one embodiment of the top surface of the bottom sheet of the applicator of the present invention comprising a plurality of cosmetic portions.
Figure 14B:
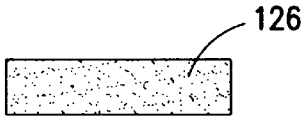
FIG. 14*b* is a top plan view of one embodiment of the top surface of the top sheet of the applicator of the present invention.
Figure 14C:
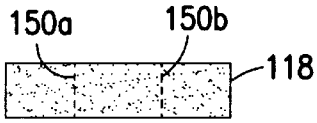
FIG. 14*c* is a top plan view of one embodiment of the top surface of the top sheet of the applicator of the present invention comprising perforations.

The device of the present invention 100 may be modified in order to optimize makeup application. For instance, the pattern of application material may be adjusted such as is shown at 140 in FIG. 11 in order to optimize application of eye shadow. The symmetry of the applicator device may be optimized such as is shown in FIGS. 12*a* and 12*b* and 13*a* and 13*b* for application of a cosmetic such as lipstick or eye shadow or blush. With the embodiment shown in FIGS. 12*a* and 12*b*, the fiber or sponge or foam applicator 126 has a rectangular shape. The cosmetic portion 114 also has a rectangular shape. With the embodiment shown in FIGS. 14*a* and 14*b*, the applicator includes a plurality of cosmetic portions 114*a*, 114*b* and 114*c*. The cosmetic portions may be different shades of eyeshadow or blush for highlighting. The fibers, foam or sponge 126 may be used to apply each of the different shades. In another embodiment illustrated in FIG. 14*c*, the top sheet 118 is perforated at 150*a* and 150*b*. The perforations permit the consumer to separate the top sheet 118 into segments for separate application of each of the shades 114*a*, 114*b* and 14*c*. By "optimize" is meant that the applicator is shaped so that a consumer can easily use the device to apply eye shadow to eyes or lipstick to lips.

One other embodiment of the device for single use comprises two separate, flat carrier sheets facing each other with a cosmetic portion having been applied to one partial surface of the first carrier sheet characterized in that the second carrier sheet which is facing the cosmetic-bearing sheet is flexible and on its entire surface is covered with, or made up of, a thin, soft, porous, flexible compound textile material which firmly adheres to the second carrier sheet and in a close state of the application device is in contact with the cosmetic.

The cosmetic-bearing partial surface of the first carrier sheet is located in the center of the carrier sheet and accounts for at least 70% of the total surface and the outer circumference is in proximity to the margin of the first carrier sheet around the cosmetic in at least in sections an adhesive has been applied which provides adhesion between the adhesive surfaces of the first carrier sheet and the facing surfaces of the fibrous material on the second carrier sheet and the adhesive strength between the two surfaces is such that it allows easy pulling off of the fiber-bearing second carrier sheet from the first carrier sheet without the adhesive surface of the first carrier sheet removing a significant amount of fibers from the second carrier sheet.

In one embodiment, the compound textile material adhering to or made up of the entire interior surface of the second carrier sheet is a nonwoven material in the shape of a very thin, matted nonwoven material whose individual fibers are of varying lengths, located at the interior surface of the sheet which comprises a pressure-sensitive adhesive. The matted nonwoven material can also be made from fiber blocks pressed onto the surface comprising a pressure-sensitive adhesive. In this, the surface of the second sheet which is in direct contact with the powder-bearing cosmetic surface, is the interior surface. The fibers are made from particularly soft material, selected from polypropylene, polyester, cotton, viscose or polyacrylic acid. Other applicator materials previously described are also suitable for use with this embodiment.

The first carrier sheet can comprise any thin material as long as cosmetic can be applied to it. The material may be flexible or non-flexible, comprising, for example, a plastic film or a coated or uncoated paper which can be printed or nonprinted on the exterior. The second carrier sheet comprises a thin, flexible material which can, for example, be a plastic, a paper, or a fiber-reinforced paper. The thickness of the film depends upon the material, order to provide the required strength when pulling it away from the adhesive and when handling it.

The adhesive is applied in dots in proximity to the exterior margin of the interior surface of the first carrier film, i.e., adhesive area approximately 1 millimeter wide and approximately 1–10 millimeters long, are distributed in a circular shape around the cosmetic, spaced apart approximately 3–10 millimeters. The adhesive is selected in such a way that on the one hand it assures adhesion between the first and second carrier films, and on the other hand enables easy separation of the one film from the other without a significant amount of fibers being pulled from the surface of the fiber-bearing sheet, but due to the great number of possible adhesives, it is up to the expert to select the most favorable one for the particular application. On the other hand, the adhesive strength of this adhesive must not be too great as the fibers might be pulled out. On the other hand, it should allow for adhesive strength which is quick to produce and provides adequate binding. Either a physically curing pressure-sensitive adhesive or a heat-assisted chemically curing adhesive can be used, for example, a polyvinyl alcohol, latex, ethyl alcohol acetate, and so on.

The cosmetic applied to the first carrier sheet is applied, in one embodiment, onto the interior of the first carrier sheet occupying a partial area on the first carrier sheet in the area of 7–25 square centimeters, in particular, 15–22 square centimeters. This means that as large a surface as possible of the inside of the first carrier sheet is covered with the cosmetic, e.g., approximately 80–90% in order to supply an adequate quantity for a single application. Only the area absolutely necessary is reserved for the adhesive.

For easier handling of the cosmetic device, it comprises a tab at the margin, formed by a tongue or material, or both adjoining carrier films, with the materials at the tongue not being together. In this way, the carrier films can be easily pulled apart.

According to a further embodiment, the non-glued part of the margin of both sheets is generally widened, formed by unbonded margins of the facing first and second carrier sheets in order to separate the sheets by pulling apart when holding both margins.

One embodiment of the invention is a cosmetic applicator device which is arranged singly in a paper wrapper. The paper wrapper can be a packet open on one side or a paper wrapper closed on all sides. In this way, several cosmetic applicators located in one package can be stored easily and free from the influence of external dirt. Thus, several applicators with individual cosmetic application devices arranged therein in a sales package are a particular preferred embodiment of the invention.

The present invention provides a complete sellable article with individual elements that provide a unit which allows the user to apply a certain quantity of cosmetic onto skin areas easily and with great comfort, and at the same time to carry the desired metered quantities in individual packages.

Figure 1:
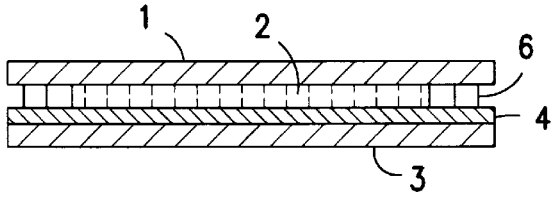
FIG. 1 is a sectional lateral view of the cosmetic device of the present invention.
Figure 2:
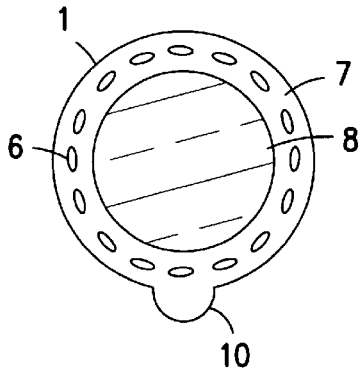
FIG. 2 is a top view of an interior surface of a first carrier sheet of the device of the present invention.

The invention covers the use of a cosmetic device by separating the fiber or other applicator material-bearing second carrier sheet from the powder-bearing first carrier sheet by pulling them apart, by taking up the cosmetic from the first carrier sheet by means of the fiber or other applicator material-bearing second carrier sheet and by evenly distributing by the fiber or other applicator-bearing second carrier sheet the cosmetic thus taken up on the skin. Below, the invention is explained in more detail by way of examples in the respective drawings as follows:

With reference to FIGS. 1 and 2, the invention comprises the first carrier sheet onto which the cosmetic has been applied to the major part of the interior surface of the sheet. The adhesive 8 has been applied to the exterior circumference 7. Facing sheet 1 in contact with sheet 1 is the second carrier sheet with the applicator material fibers 4 on it. In those positions where it is located on the exterior circumference 7, the adhesive 6 adheres to the fibers 4.

Figure 3:
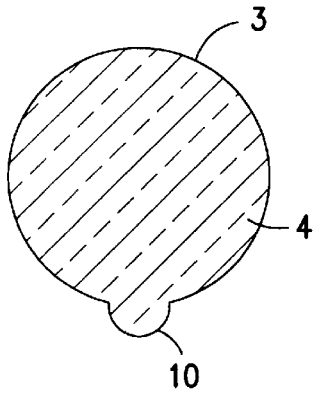
FIG. 3 is a top view of an interior surface of a second carrier sheet of the device of the present invention.

According to FIGS. 2 and 3, both the first carrier sheet 1 and second carrier sheet 3 are enlarged by a tab. In the state where the two films are bonded together, the non-bonded tabs 10 are placed one above the other, thus making it possible for the user to pull the two sheets apart.

Figure 4:
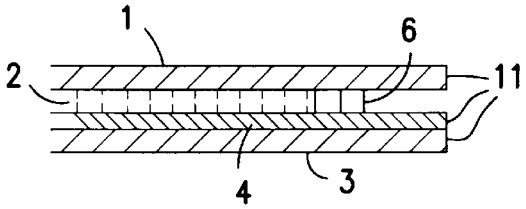
FIG. 4 is a lateral view of a marginal area of a cosmetic device according to a further embodiment.

In the embodiment according to FIG. 4, the margin of the two films is generally somewhat wider by an enlargement of the margin. The widened margin is not bonded, thus making it possible to pull the sheets apart at any location.

Figure 9A:
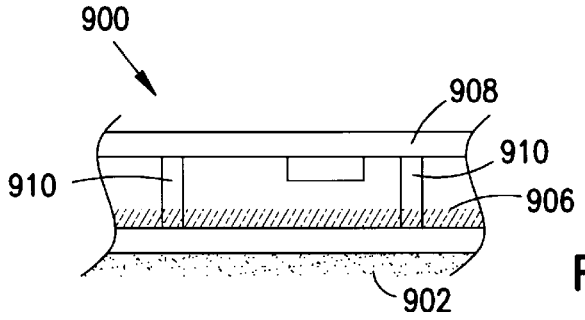
FIG. 9*a* is a cross sectional view of one other embodiment of the device of the present invention.

In one other embodiment of the applicator illustrated at 400 in FIG. 9*a*, a second sheet 402 includes fibers on each of a top surface 404 and a bottom surface 406. The first sheet 408 and adhesive 410 are prepared in a manner described herein. The fibers may be of a different type on each surface for performing functions of application and smoothing on the skin.

It is to be appreciated that the applicator device of the present invention has been described in particular detail with respect to preferred processes and structures. The present invention, however, is not intended to be limited to these preferred embodiments. One skilled in the art will readily recognize that the actual method and device may be adjusted to accommodate particular conditions.

What is claimed is:

1. A powder device for a single application, comprising:

two separate, flat carrier films facing each other, with a powder having been applied to one partial surface of a first carrier film forming a powder-bearing film characterized in that a second carrier film which is facing the powder-bearing film is flexible and on an entire interior surface of the second carrier film is a thin, soft, porous, flexible textile material which firmly adheres to the second carrier film and in a closed state, the powder bearing partial surface is in contact with the powder; wherein the powder-bearing partial surface of the first carrier film is located in the center of said carrier film and accounts for at least 70% of the total surface; and an adhesive at an outer circumference in proximity to a margin of the first carrier film which provides adhesion between the adhesive surfaces of the first carrier film and the facing surfaces of the fibrous material on the second carrier film and the adhesive strength between the two surfaces is such that it allows for easy pulling off of the fiber-bearing second carrier film from the first carrier film without the adhesive surfaces of the first carrier film removing a significant amount of fibers from the second carrier film.

2. An applicator device, comprising:

a first sheet comprising a bottom surface and a top surface;

a cosmetic portion positioned on the top surface of the first sheet;

a second sheet comprising a bottom surface facing the top surface of the first sheet and the cosmetic portion and a top surface;

a plurality of fibers positioned on the top surface of the second sheet; and adhesive that adheres the first sheet to the second sheet.

3. The applicator device of claim 2 and further including a container that encloses the first sheet and the second sheet.

4. The applicator device of claim 2 and further comprising fibers on the bottom surface of the second sheet wherein the adhesive contacts the fibers.

5. The applicator device of claim 2 wherein the cosmetic portion is a powder.

6. The applicator device of claim 2 wherein the cosmetic portion is selected from a group consisting of lipstick, eye shadow, blush, and mascara.

7. The applicator device of claim 2 wherein the cosmetic portion is of a single use amount.

8. The applicator device of claim 16 wherein one or more of the applicator devices further comprises fibers on the bottom surface of the second sheet wherein the adhesive contacts fibers.

9. The applicator device of claim 8 wherein fibers remain adhered to the top surface after separation from the adhesive.

10. The applicator device of claim 3 and further comprising printing on the container.

11. An applicator device comprising:

a first sheet comprising a bottom surface and a top surface;

a cosmetic portion positioned on the top surface of the first sheet;

a second sheet comprising a bottom surface facing the top surface of the first sheet and the cosmetic portion and a top surface wherein the top surface comprises foam or sponge; and an adhesive that adheres the first sheet to the second sheet.

12. The applicator device of claim 11 and further comprising fiber, foam, or sponge or a combination of fiber, foam, or sponge on the bottom surface of the second sheet wherein the fiber, foam or sponge contacts the adhesive.

13. The applicator device of claim 11 wherein the cosmetic portion is a powder.

14. The applicator device of claim 11 wherein the cosmetic portion is selected from a group consisting of lipstick, eye shadow, blush, and mascara.

15. The applicator device of claim 11 wherein the cosmetic portion is of a single use amount.

16. A cosmetic applicator kit, comprising:

one or more of an applicator device comprising a first sheet comprising a bottom surface and a top surface;

a cosmetic portion positioned on the top surface of the first sheet;

a second sheet comprising a bottom surface facing the top surface of the first sheet and the cosmetic portion and a top surface;

a plurality of fibers positioned on the top surface of the second sheet;

adhesive that adheres the first sheet to the second sheet; and a container for containing the applicator device.

17. The applicator kit of claim 16 wherein each applicator device comprises a different cosmetic portion.

18. The applicator kit of claim 16 wherein the container contains multiple applicator devices.

19. The applicator kit of claim 18 wherein the multiple applicator devices comprise cosmetic portions selected from the group consisting of lipstick, eye shadow, blush and mascara.

20. The applicators kit of claim 19 and further comprising one or more applicator of claim 4.

* * * * *